United States Patent [19]

Simpson

[11] 4,439,235

[45] Mar. 27, 1984

[54] CHLORINATION PROCESS FOR REMOVING PRECIOUS METALS FROM ORE

[75] Inventor: Charles H. Simpson, Scottsdale, Ariz.

[73] Assignee: James J. Shepard, Jr., Bedford, Pa.

[21] Appl. No.: 388,112

[22] Filed: Jun. 14, 1982

Related U.S. Application Data

[63] Continuation-in-part of Ser. No. 345,597, Feb. 4, 1982, abandoned.

[51] Int. Cl.[3] ..... C22B 3/00; C22B 11/04; C01G 55/00; C01G 7/00

[52] U.S. Cl. ..... 75/101 R; 75/104; 75/111; 75/118 R; 423/23; 423/27; 423/38

[58] Field of Search ..... 75/101 R, 104, 111, 75/118 R; 423/23, 27, 38, 40, 43, 46, 39, 140

[56] References Cited

U.S. PATENT DOCUMENTS

| | | | |
|---|---|---|---|
| 1,066,855 | 7/1913 | Slater et al. | 75/104 |
| 2,438,781 | 9/1944 | Kamlet | 423/473 |
| 2,829,966 | 4/1958 | Raymond et al. | 423/39 |
| 3,627,482 | 12/1971 | Olson et al. | 75/101 R |
| 4,342,592 | 8/1982 | Lamb | 423/40 |

FOREIGN PATENT DOCUMENTS

| | | | |
|---|---|---|---|
| 17441 | of 1907 | United Kingdom | 423/38 |

*Primary Examiner*—Edward J. Meros
*Assistant Examiner*—Chung K. Pak
*Attorney, Agent, or Firm*—Drummond & Nissle

[57] ABSTRACT

A process for removing precious metals from comminuted ores. The process comprises the steps of first contacting comminuted ore with a primary acidic hypochlorite solution, separating the ore from the primary hypochlorite solution and then contacting the separated ore with an aqueous hypochlorite solution having a pH greater than 7.

2 Claims, 1 Drawing Figure

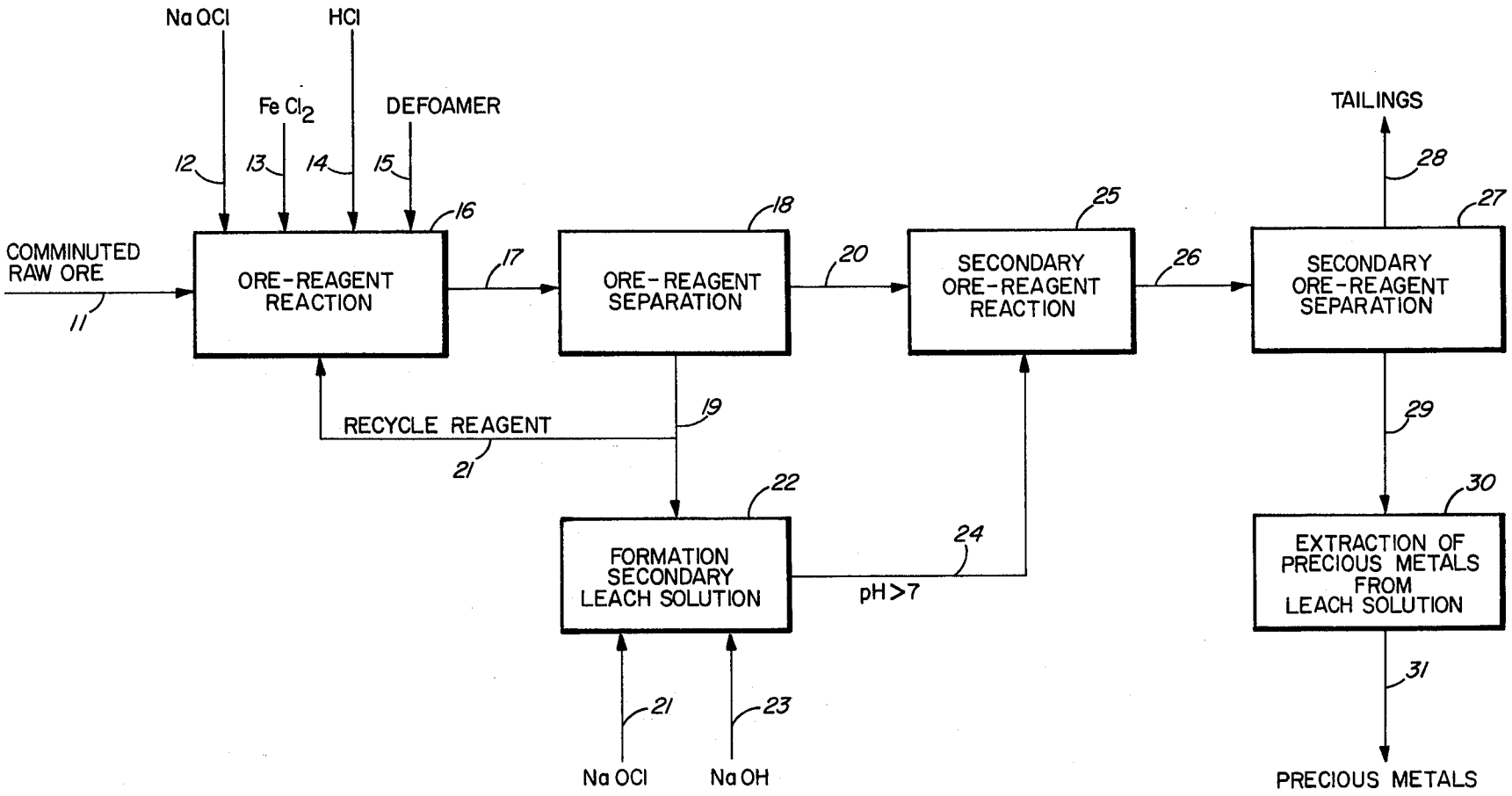
COMMINUTED RAW ORE
11
Na OCl
12
Fe Cl2
13
HCl
14
DEFOAMER
15
16
ORE-REAGENT REACTION
17
ORE-REAGENT SEPARATION
18
19
20
SECONDARY ORE-REAGENT REACTION
25
26
SECONDARY ORE-REAGENT SEPARATION
27
TAILINGS
28
29
EXTRACTION OF PRECIOUS METALS FROM LEACH SOLUTION
30
31
PRECIOUS METALS
RECYCLE REAGENT
21
FORMATION SECONDARY LEACH SOLUTION
22
pH>7
24
Na OCl
21
Na OH
23

CHLORINATION PROCESS FOR REMOVING PRECIOUS METALS FROM ORE

This application comprises a continuation-in-part of my U.S. application, Ser. No. 345,597, for "CHLORINOLYSIS PROCESS FOR DESULFURIZING COAL", filed Feb. 4, 1982 now abandoned.

This invention relates to methods for extracting precious metals from ores.

More particularly, the invention relates to a low temperature chlorination process which can, in a relatively short period of time and without utilizing cyanide compounds, solubilize gold, silver and other precious metals contained within oxide, sulfide and carbonaceous ore.

Processes for removing precious metals from ores are well known in the art. Such processes often utilize cyanide, a substance well known for its toxicity, and require long periods of time to remove substantial amounts of precious metals from ore. See, for example, "Silver and Gold Recovery for Low-Grade Resources" by Gene E. McClelland and S. D. Hill (*Mining Congress Journal*, May 1981); "Processing Gold Ores Using Heap Leach-Carbon Adsorption Methods" by H. J. Heinen, D. G. Peterson and R. E. Lindstrom (United States Department of the Interior, *Bureau of Mines Information Circular 8770*, 1978); "Recovering Gold from Stripping Waste and Ore by Percolation Cyanide Leaching" by George M. Potter (United States Department of the Interior, Bureau of Mines Technical Progress Report 20, Dec. 1969); "Innovations in Gold Metallurgy" by G. M. Potter and H. B. Salisbury (Presented at the *American Mining Congress 1973 Mining Convention/Environment Show*, Denver, Colorado, Sept. 9–12, 1973); U.S. Pat. No. 3,635,697to Scheiner, et al.; and "Pressure Stripping Gold from Activated Carbon" by J. R. Ross, H. B. Salisbury and G. M. Potter (Presented at the *AIME Annual Conference, SME Program*, Chicago, Ill., Feb. 26–Mar. 1, 1973).

Problems which occur during the cyanidation of ore to recover gold and silver include locking of precious metals so that cyanide solutions cannot penetrate and dissolve the precious metals; the existence, or formation during leaching, of strongly adherent films on the surface of native gold and silver, inhibiting or preventing further dissolution of the metals; high cyanide consumption which is often accompanied by high lime consumption; long leach times required because of very slow reaction of precious metal minerals with cyanide; leach solution fouling, rendering it inactive for precious metal dissolution and often causing difficulties in metal precipitation from pregnant solution; readsorption or reprecipitation of precious metal from solution after initial dissolution; and toxic arsine gas formation on precipitating precious metal from pregnant solution.

Further, prior to cyanidation, ores must be oxidized. Such oxidation is often accomplished with chlorine or a hypochlorite. See U.S. Pat. No. 3,639,925 to Scheiner, et al.; "Extraction of Gold from Carbonaceous Ores: Pilot Plant Studies" by B. J. Scheiner, R. E. Lindstrom, W. J. Guary and D. G. Peterson (United States Department of the Interior, *Bureau of Mines Report of Investigations 7597*, 1972); "Oxidation Process for Improving Gold Recovery from Carbon-Bearing Gold Ores", by B. J. Scheiner, R. E. Lindstrom, and T. A. Henrie (United States Department of the Interior, *Bureau of the Mines Report of Investigations 7573*, 1971). Problems that can occur during chlorine oxidation of ore include high chlorine consumption, particularly if substantial quantities of sulfide are present; high lime consumption, which is related to the high chlorine consumption since oxidation of sulfides results in the formation of sulfuric acid which consumes lime; solubilization of ore components by chlorine which fouls the leach solution and causes difficulties in the precipitation of precious metals; and, the dissolution of base metals by chlorine, which cements the metals out of solution during zinc precipitation and causes difficulties in obtaining acceptable dore fineness when refining the precipitate. See "Gold and Silver Extraction from Sulfide Ores" by Richard Addison (*Mining Congress Journal*, Oct. 1980).

Amalgamation, roasting, gravity separation, fire refining and smelting techniques are also utilized to separate gold from ores.

In accordance with the invention, I have now discovered an improved process for removing precious metals from ores. My new method utilizes in part the process described in my copending U.S. Patent application, Ser. No. 345,597, and eliminates the necessity of utilizing cyanide compounds to successfully remove substantial amounts of gold from ore. The improved method is highly effective at temperatures below the vaporization temperature of water and requires that ore be contacted with leach solution for only relatively short periods of time.

In order to simultaneously extract gold, silver and other precious metals from ores, I deliberately adjust the process conditions to insure that comminuted ore is contacted first with an acidic primary leach solution and is then contacted with a basic secondary leach solution.

To achieve these process conditions, I contact comminuted ore with aqueous leach solutions of a hypochlorite, preferably sodium or calcium hypochlorite. The leach solutions also contain ferric or ferrous ion and a catalyst which initiates the reaction between the leach solution and carbonaceous ore. The presently preferred catalyst is hydrochloric acid, although hypochlorous, chloric and other oxy-acids of chlorine would be acceptable substitutes, as would sulfurous and hydrosulfuric acids. Hydrogen sulfide may also be employed because it reacts with chlorides to form hydrochloric acid in situ.

In acqueous solution hypochlorite ion is unstable with respect to self-oxidation and, when warmed disproportionates to produce chloride ion and chlorate ion ($ClO_3$). Accordingly, in place of calcium and sodium hypochlorite and to simulate the same, various water soluble metal chlorides, chlorates and/or chlorites can be added to the leach solution and will react in situ to form hypochlorite and/or chloride and chlorate ions when the leach solution is heated to 80° C. Cupric, barium, bismuth, zinc, silver and bromine chlorides could be utilized in this respect. Similarly, manganese dioxide or oxide ore could be utilized since they would combine with chloride ions in solution to form manganese chloride. Magnesium chloride may also be used.

Prior to being slurried with primary leach solution, raw ore is washed to remove shale, dirt and other gangue and is crushed to particles approximately one-half inch in size. These particles are then fed into a ball mill for reduction to 50–300 mesh particles. Fine grinding of the ore is desirable because it facilitates rapid interaction between precious metal compounds contained in the ore matrix and chemicals in the leach solution.

Ground ore and primary leach solutions are ideally combined at a temperature of 80°–85° C. The leach solution has a pH of 4–6. Although the primary leach solution will extract precious metals from the ore at lower and higher temperatures, the chlorination leach process does not appear to function as efficiently at these temperature extremes.

The necessary ferric or ferrous ion can be supplied by adding an iron sulfate or ferric chloride reagent to the extraction mixture slurry. Other iron salts, iron hydroxide, metallic iron or any iron compounds that will react in situ in the ore-leach solution extraction mixture slurry to form an iron chloride or sulfate can also be combined with the extraction mixture slurry.

Presently, approximately 0.25 to 2.0 pounds of concentrated hydrochloric acid is added to the extraction mixture slurry for each one hundred pounds of ore in the slurry. The hydrochloric acid, as earlier noted, serves as a catalyst which initiates the chemical reaction between the hypochlorite, ferric or ferrous ions and precious metal compounds in the ore.

As earlier described, fine grinding of the ore facilitates a rapid and complete reaction between precious metal compounds in the ore and the chemicals in the leach solution. The ore-leach solution chemical reactions are exothermic and may raise the temperature of the extraction mixture slurry from ambient temperature to a temperature as high as 50° C. Thus, the only additional heat necessary while the leach solution is initially maintained in contact with comminuted ore is a quantity of heat which will raise the temperature of the extraction mixture slurry from about 50° C. to 80° C.

The rapid, almost instantaneous reaction between the ore and leach solution chemicals causes foaming and requires that an emulsifier be added to the extraction mixture slurry. A silicone emulsifier manufactured by Dow Chemical Co. is presently utilized.

The ore and primary leach solution are preferably combined and agitated in a closed reaction vessel both to retain heat thrown off by the exothermic chemical reactions which occur and to reduce the quantity of chemical reagents which escape into the air during the agitation of the extraction mixture slurry. Since only a portion of each chemical component in the leach solution is normally consumed during treatment of a quantity of ore, the leach solution can be separated from the treated ore, replenished with the necessary amount of each reaction chemical and then recycled for treatment of another quantity of ore.

After the ore and primary leach solution are initially maintained in contact for 15–30 minutes, the extracted comminuted ore is separated from the primary leach solution. A secondary leach solution is formed by adding supplemental hypochlorite and a base to the metal rich primary leach solution. A sufficient amount of a base, for instance sodium hydroxide, is added to the primary leach solution to raise the pH of the secondary leach solution above 7.

Secondary leach solution is then combined with extracted comminuted ore separated from the primary leach solution. The extracted ore and secondary leach solution are contacted for 15–30 minutes at a temperature of 80°–100° C., and are then separated. The secondary leach solution is processed to remove the solubilized precious metals therefrom.

I have discovered that utilizing a two step treatment process in which ore is first subjected to a primary acidic leach solution and is then subjected to a basic secondary leach solution successfully removes the large majority of precious metals from ores. It appears to be particularly important for the secondary leach solution to continually have a pH in excess of 7 during mixing of extracted comminuted ore and secondary leach solution.

The drawing illustrates an overall integrated process for producing precious metals from ores. Raw comminuted ore 11 is combined 16 with a primary leach solution including sodium hypochlorite 12, ferric chloride reagent 13, hydrochloric acid 14 and defoamer 15. If desired, raw ore can be ground while being contacted with leach solution during ore-reagent reaction step 16. Additional water may be added during the ore-reagent reaction step 16 to produce an extraction mixture slurry having the desired viscosity. Prior to being comminuted and contacted with a primary leach solution 16, raw ore is normally crushed and then washed to remove dirt and shale. During ore-reagent reaction step 16, comminuted ore 11 may be combined with the primary leach solution at any desired pressure.

After comminuted ore 11 and leach solution are combined in reaction step 16, an exothermic reaction takes place which raises the temperature of the extraction mixture slurry to 30° to 50° C. Additional heat is supplied so that the temperature of the extraction mixture slurry is raised to 80°–100° C. during ore-reagent reactions 16. After the primary leach solution has contacted comminuted ore 11 for approximately 30 minutes, extraction mixture slurry 17 is separated 18 into a liquid component 19 and solids component 20. Liquid component 19 comprises the precious metal rich primary leach solution. Solids component 20 comprises the extracted comminuted ore. The separated metal rich primary leach solution 19 may be recycled 21 for use in ore-reagent reaction step 16.

During formation of the secondary leach solution 22 additional sodium hypochlorite 21 is added to separated primary leach solution 19. A quantity of sodium hydroxide 23 sufficient to raise the pH of the separated primary leach solution to 9–10 is also combined with leach solution 19.

Secondary leach solution 24 is combined with separated comminuted ore 20 during secondary ore-reagent reaction step 25. Ore 20 and leach solution 24 are combined at a temperature of 80°–100° C., preferably for approximately 30 minutes. After 30 minutes, secondary extraction mixture slurry 26 is separated into secondary solid component 28 and metal rich secondary liquid component 29. Solid component 28 can be discarded as tailings or, if desired, may be recycled. Liquid component 29 is treated 30 to remove the precious metals 31 contained therein.

Precious metals 31 may be extracted from leach solution 29 by running the leach solution over a resin bed. A 5% by weight aqueous solution of thiourea will elute the precious metals from the resin bed.

It is important that leaching the ore with acidic and basic leach solutions be carried out between temperatures of 50° to 100° C. If comminuted ore is combined with leach solution at temperatures in excess of 100° C., gold is still extracted from ore but in lesser amounts because the ore is "burned". When the ore is "burned" carbon chains begin to break down and the leach solution turns black as carbon combines with gold in solution. Temperatures in excess of 100° C. also cause chemicals in the leach solution to begin to vaporize and, consequently, tend to decrease the efficiency of the leach solution in freeing up precious metal entrapped in the ore. At temperatures less than 50° C., gold is extracted from the ore but only at a very slow rate.

As earlier noted, the primary leach solution is acidic and preferably has a pH in the range of 4–6. The secondary leach solution, while containing the same key chemical components as the primary leach solution, is basic and preferably has a pH of 9–10. To raise the pH of the secondary leach solution to the range of 9–10, sodium carbonate, sodium hydroxide or any other base may be utilized which does not precipitate metal from solution.

Acid 14 and iron 13 appear to play important catalytic roles in the process of the invention. The acid initiates the chemical reactions which take place while the iron evidently plays an important part in breaking down various ores to free gold entrapped in the ores. If small effective amounts of acid 14 and iron 13 are not present in the hypochlorite leach solution, the process of the invention does not appear to function efficiently.

The following examples are presented, not by way of limitation of the scope of the invention, but to illustrate to those skilled in the art the practice of various of the presently preferred embodiments of the invention and to distinguish the invention from the prior art.

EXAMPLE 1

A sample of Nevada carbonaceous ore was obtained. The ore contained oxide and sulfide minerals. The ore was analyzed and the following results were obtained:

TABLE A

| Nevada Carbonaceous Ore # 1 | |
|---|---|
| Component | Wt. % |
| Gold | 0.13 (oz/ton) |
| Silver | 0.01 (oz/ton) |
| Sulfur | 0.92 |
| Copper | 108 (ppm) |
| Carbon | 7.65 |
| Iron | 1.09 |
| Loss of Ignition | 20.75 |

One hundred grams of the ore were ground to 100 mesh and then mixed in a stirred reaction vessel at room temperature and atmospheric pressure with a primary leach solution including 500 grams of water, 500 grams of sodium hypochlorite, 20 ml of hydrochloric acid, two grams of ferric chloride and 3 grams of DB-110 defoamer. The leach solution had a pH of 4–5 when it was initially combined with the comminuted carbonaceous ore. Interaction between the ore and leach solution caused an exothermic reaction which raised the temperature of the ore-leach solution extraction mixture slurry to a temperature of approximately 50° C. Additional heat was applied to the reaction vessel to raise the temperature of the extraction mixture slurry to 95° C. After 30 minutes the extracted comminuted ore was separated from the precious metal rich primary leach solution. The extracted comminuted ore was retained and again leached with a secondary leach solution as described below. The primary leach solution was analyzed and the following results obtained:

TABLE B

| Primary Leach Solution | |
|---|---|
| Component | mg/L |
| Gold | 0.23 |
| Silver | lt* 0.1 |
| Iron | 6.8 |

TABLE B-continued

| Primary Leach Solution | |
|---|---|
| Component | mg/L |
| Copper | 1.8 |
| Sulfur | 410.0 |

*lt = less than

The extracted comminuted ore was washed wth two liters of 100° C. water. The wash solution was analyzed and the following results obtained:

TABLE C

| Wash Solution (From once leached ore) | |
|---|---|
| Component | mg/L |
| Gold | lt* 0.1 |
| Silver | lt* 0.1 |
| Iron | 4.5 |
| Copper | 0.1 |
| Sulfur | 26.0 |

*lt = less than 500 ml of the leach solution of Table B was combined with 500 ml of sodium hypochlorite and 5 grams of sodium hydroxide to form a secondary leach solution. The pH of the secondary leach solution was 9–10. The entire quantity of secondary leach solution was mixed with the once-leached extracted comminuted ore for 30 minutes in a stirred reactor at a temperature of 95° C. After 30 minutes the twice extracted comminuted ore was separated from the precious metal rich secondary leach solution. The separated secondary leach solution was analyzed and the following results obtained:

TABLE D

| Secondary Leach Solution | |
|---|---|
| Component | mg/L |
| pH | 7.6 |
| Gold | 0.61 |
| Silver | lt* 0.5 |
| Iron | 2.7 |
| Copper | 1.1 |
| Sulfur | 920.0 |

*lt = less than

The twice extracted comminuted ore was washed with two liters of 100° C. water. The wash solution was analyzed and the following results obtained:

TABLE E

| Wash Solution (From twice leached ore) | |
|---|---|
| Component | mg/L |
| pH | 7.9 |
| Gold | lt* 0.05 |
| Silver | lt* 0.05 |
| Iron | 0.8 |
| Copper | 0.08 |
| Sulfur | 55.0 |

The twice extracted comminuted ore was analyzed and the following results obtained:

TABLE F

| Twice Leached Carbonaceous Ore | |
|---|---|
| Component | oz/ton |
| Carbon | 6.23 (wt %) |
| Copper | 73.4 (ppm) |
| Gold | lt* 0.01 |
| Iridium | lt* 0.01 |
| Iron | 0.191 (wt %) |
| Palladium | lt* 0.01 |
| Platinum | lt* 0.01 |

TABLE F-continued

| Twice Leached Carbonaceous Ore | |
|---|---|
| Component | oz/ton |
| Rhodium | lt* 0.01 |
| Silver | 15* 0.01 |

*lt = less than

EXAMPLE 2

One hundred grams of the Nevada carbonaceous ore of Example 1 was treated as described in Example 1. However, the secondary basic leach solution, instead of being formed from recycled primary leach solution, was formed by taking fresh primary leach solution and adjusting the pH of the fresh primary leach solution to 9–10. All of the other process parameters described in Example 1 were maintained. Results were obtained which were similar to those of Example 1.

As earlier noted, when sulfide or oxide ore 11 is contacted with an acidic aqueous solution of hypochlorite 12, iron ore 13, and acid 14 at an elevated temperature, precious metals will be removed from the ore into solution. However, it is preferable to contact ore with an acidic aqueus solution of hypochlorite, iron ion and acid at an elevated temperature in the range of 80° to 100° C. If desired, the temperature of the ore-aqueous solution extraction mixture slurry in step 16 can be varied during the time the ore and aqueous solution are maintained in contact during step 16.

As would be appreciated by those of skill in the art, the temperatures maintained during ore-reagent separation step 18, secondary ore-reagent step 25 and all other process steps prior or consequent to ore-reagent contact step 16 can be varied and/or maintained at any level desired in view of the prior art and in view of chemical reagents or processes employed during these prior or subsequent process steps. Ordinarily, the temperatures maintained during each of the steps 16, 18, 25, etc. in a treatment process will not, of course, be equivalent.

Having described my invention in such terms as to enable those skilled in the art to which it pertains to understand and practice it, and having described the presently preferred embodiments thereof, I claim:

1. A process for removing precious metal values from comminuted carbonaceous ores, comprising the steps of (a) contacting said comminuted ore at an elevated temperature below 100° C. with an effective amount of an acidic aqueous solution of hypochlorite, iron ion and an acid to form an extraction mixture slurry including
  (i) an aqueous liquid component including said hypochlorite, iron ion and acid and containing precious metal values from said comminuted ore dissolved therein, and
  (ii) a solid component comprising said comminuted extracted ore, (b) separating said liquid and solid components of said extraction mixture slurry, (c) contacting said separated solid component of said extraction mixture slurry at an elevated temperature below 100° C. with an effective amount of an aqueous solution of hypochlorite and iron having a pH greater than 7 to form a secondary extraction mixture slurry including
  (i) a secondary aqueous liquid component including said hypochlorite and iron ion and containing precious metal values from said comminuted ore dissolved therein; and
  (ii) a secondary solid component comprising twice extracted comminuted ore, (d) separating said liquid and solid components of said secondary extraction mixture slurry; and (e) removing said precious metal values from said separated secondary liquid component.

2. The process of claim 1 wherein the basic aqueous solution of step (c) is formed by adding to said liquid component of step (b) the amount of base necessary to increase the pH of said liquid component of step (b) to a selected point greater than 7.

* * * * *